US005388649A

United States Patent [19]

Ilomäki

[11] Patent Number: 5,388,649

[45] Date of Patent: Feb. 14, 1995

[54] DRILLING EQUIPMENT AND A METHOD FOR REGULATING ITS PENETRATION

[76] Inventor: Valto Ilomäki, Loilantie 8, 33470 Ylöjärvi, Finland

[21] Appl. No.: 119,234

[22] PCT Filed: Mar. 25, 1992

[86] PCT No.: PCT/FI92/00085

§ 371 Date: Sep. 24, 1993

§ 102(e) Date: Sep. 24, 1993

[87] PCT Pub. No.: WO92/16718

PCT Pub. Date: Oct. 1, 1992

[30] Foreign Application Priority Data

Mar. 25, 1991 [FI] Finland ..... 911415

[51] Int. Cl.[6] ..... E21B 44/00; E21B 10/62

[52] U.S. Cl. ..... 175/27; 175/57; 175/381

[58] Field of Search ..... 175/381, 382, 57, 24, 175/27

[56] References Cited

U.S. PATENT DOCUMENTS 1,612,338 12/1926 Wilson et al. ..... 175/381 X
2,819,041 1/1958 Beckham ..... 175/381 X
2,942,850 6/1960 Heath ..... 175/381 X
3,924,690 12/1975 Shaw ..... 173/13
4,386,669 6/1983 Evans ..... 175/381 X

FOREIGN PATENT DOCUMENTS 158410 8/1915 Germany ..... 175/381
434168 11/1974 U.S.S.R. ..... 175/381

OTHER PUBLICATIONS

Derwent's Abstract, No. 84–80 378/13; 16.06.81.

*Primary Examiner*—Hoang C. Dang
*Attorney, Agent, or Firm*—Larson and Taylor

[57] ABSTRACT

An apparatus comprising a rotatable tool having a drill head and a method for regulating the penetration of the apparatus in rock or soil are disclosed. In particular, the apparatus and method of the invention are designed to prevent damage to drill bits mounted on the drill head when any one of the drill bits encounters an excessive opposing force as, for example, would result if the drill bits impacted a rock when drilling in soil. The apparatus includes mechanism for detecting the excessive force acting on one or more drill bits and automatically restricts the driving force which moves the tool forward.

7 Claims, 2 Drawing Sheets

DRILLING EQUIPMENT AND A METHOD FOR REGULATING ITS PENETRATION

FIELD OF THE INVENTION

The invention relates to an apparatus for drilling in soil or rock and a method for regulating its penetration, where the penetration is restricted if one or more drill bits are overloaded.

BACKGROUND OF THE INVENTION

Previously known drilling equipment is described in Finnish Application No. 891706, in which drilling is carried out either by means of a hammering or a rotating tool. The application describes how a hammer furnished with a drill bit and with or without a bit-rotating tool can be backed into its cylinders if the drilling unit is driven too far forward.

The pressure shocks caused by the tool upon drilling are a disadvantage of the above solution, because they disturb the control of backing the whole tool unit. Generally, it is possible to control the backing of the tool only when the drill head is driven on the wall which is being drilled and detection of the whole drill head reading the target is possible as a result of the backing of the tool.

SUMMARY OF THE INVENTION

The present invention enables elimination of possible damage to the single bits and dependable control of the backing of the drill bits. The invention is characterized by the features described in the patent claims.

It can be considered the major advantage of the invention that even in a multi-bit tool the single bits can be controlled individually, their overload detected and, accordingly, the feed motion stopped or feeding force restricted in order to prevent the bits from being damaged. With such a tool it is possible to drill in soft soil very fast and on facing rock, no matter at which angle, even at the reach of one bit only, because, due to its backing capacity, the bit is not damaged. A single bit in a conventional multi-bit tool would not remain undamaged in such a situation since it would then have to sustain the whole feeding force alone.

BRIEF DESCRIPTION OF THE DRAWINGS

In the following, the invention is described in detail with reference to the enclosed drawings where:

FIG. 1 shows a rotatable tool 1 at the head of which there are several drill bits of different types. As a matter of principle, all the bits are cutting discs 4 which, on cutting soil or rock, move into slow rotation around their shaft while tool 1 is rotated and fed forward. The drill bit rods 5 are at the same time rods of pistons 6 of hydraulic cylinders 7, at the heads of which supporting parts 2,3 for the cutting discs 4 are fixed.

FIG. 2 shows a hydraulic system by means of which the backing of a bit is functioning. From the former cylinder, hydraulic pressure enters into cylinder 7 through back-valve 18. The drill bit and the piston are then in a slightly backed, or rearward position.

Figure 1:
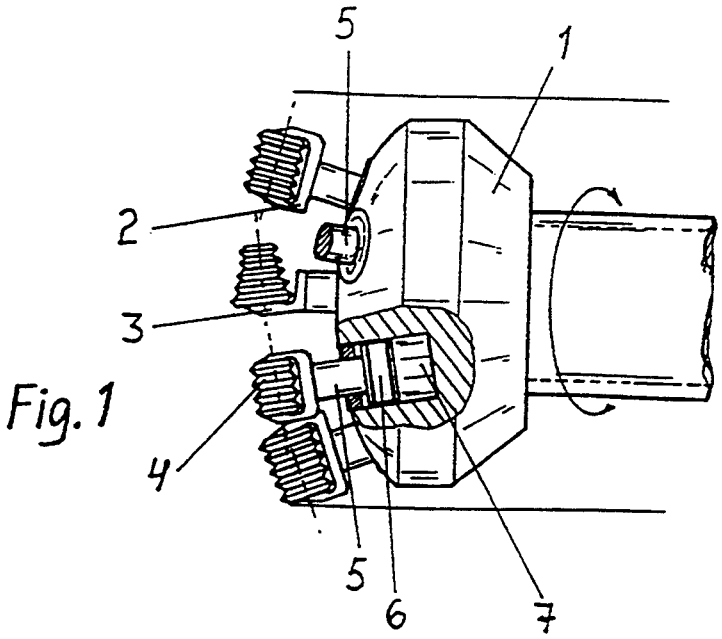
FIG. 1 is a multi-bit drilling tool.

1. If feeding is stopped because of overload in this drill bit, the piston is affected by pressure, e.g. adjusted to 100 bar, over valve 18, pushing the piston to its extreme, or forward position. From the other side of the piston, oil escapes through valve 15, the opening pressure of which is, for instance, 120 bar. Due to the considerably smaller cross-sectional area of the piston, pressure can rise even more thereby opening valve 15 and allowing oil to flow to lower pressure. When no oil leaks out through the oil outlet pipe 12, this is a sign that the piston is in a backed position at least in one of the cylinders.

When the piston reaches its extreme position the spindles 13 and 14 open respective valves, so that oil starts to flow through the piston along channel 17 and further along channel 12 to the next cylinder. The piston remains in its extreme position if there is no overload, though the same pressure of ab. 100 bar prevails on both sides of the piston. In the piston, a force remains active which is caused by the cross-sectional ratio and considered proper load for the drill bit. If there was a similar backed situation in other series-connected cylinders, the pressure of ab. 100 bar along channel 12 to the next cylinder would cause travel of the corresponding piston to its extreme position and only then a forward flow of oil along channel 12 again.

Figure 2:
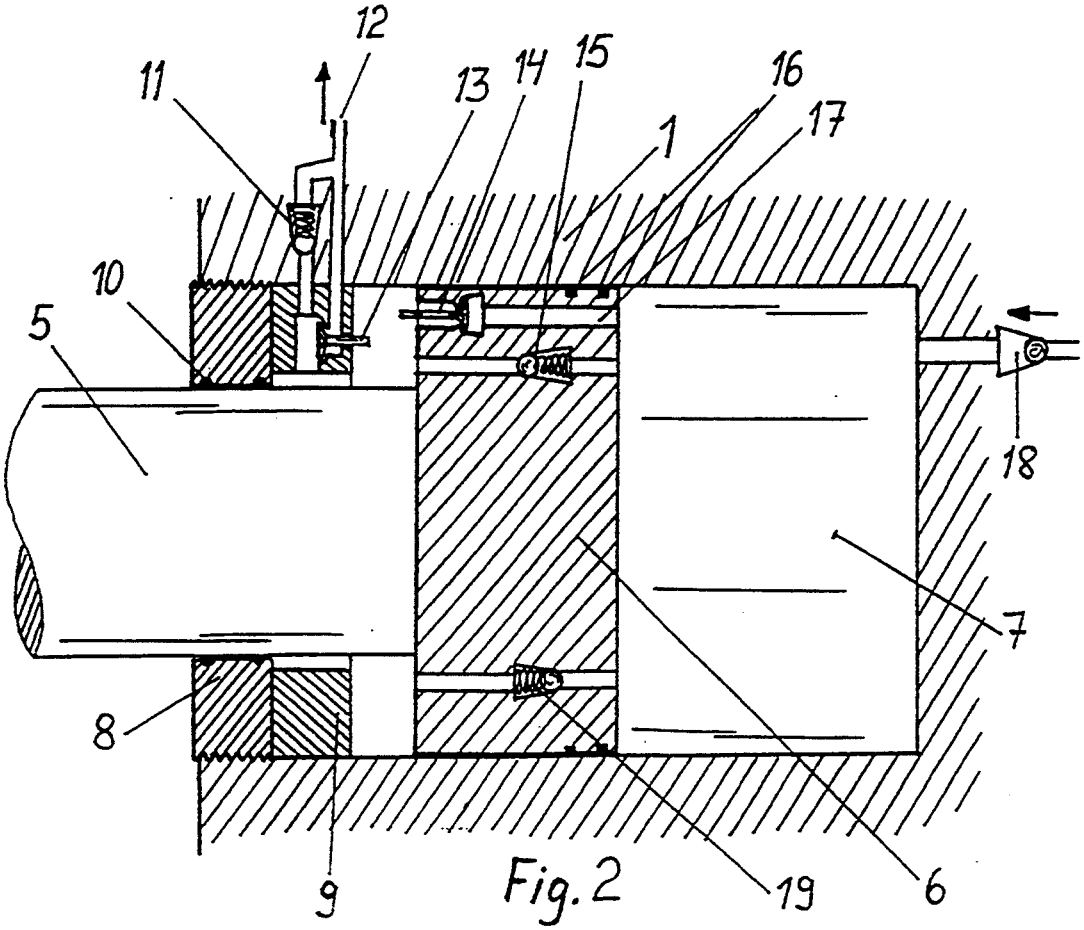
FIG. 2 is a cross-section of a shock-absorbing cylinder of a bit.

2. If there is an overload situation in FIG. 2 where piston 6 is still backing, valve 19 opens letting oil through the piston. Proper opening pressure would be 180 bar for instance. Then also valve 11 must let some oil forward and its opening pressure could be 140 bar. Backing stops as soon as the forward feeding of tool is switched off.

A situation where a cylinder has moved into backing position can be detected from the total or almost total interruption of oil flow from channel 12.

Figure 3:
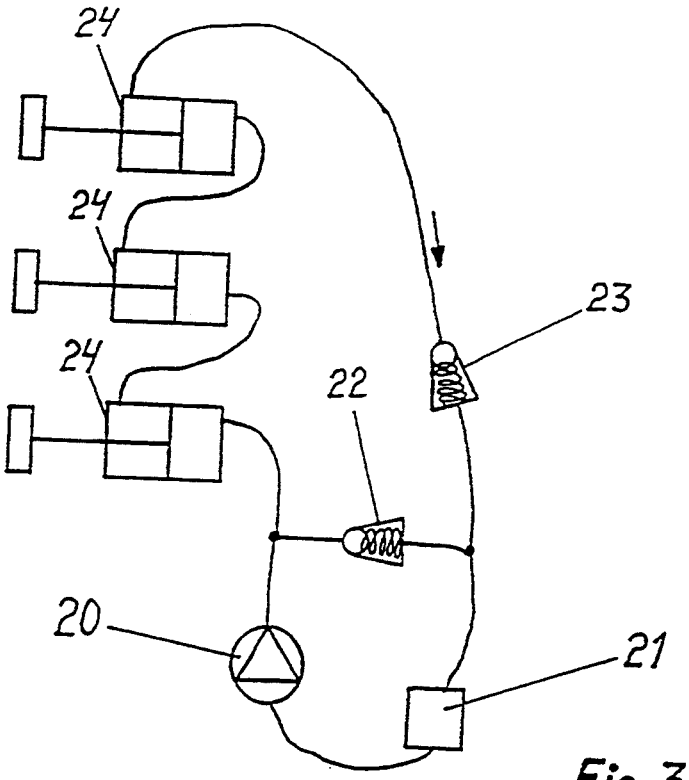
FIG. 3 is a diagram of a hydraulic system.

FIG. 3 shows a hydraulic diagram of a series connection of cylinders 24. The feeding pressure upper limit is kept at least in 100 bar with regulation valve 22. The valve lets oil into tank 21 when the pressure limit is clearly exceeded. Valve 23 regulates and sustains pressure in cylinders. The valve opening pressure can be 100 bar. If valve 23 allows oil through the same flow as the pump displacement, all drill bits are then in their extreme position. A smaller flow of oil indicates that one or more drill bits are backed.

Figure 4:
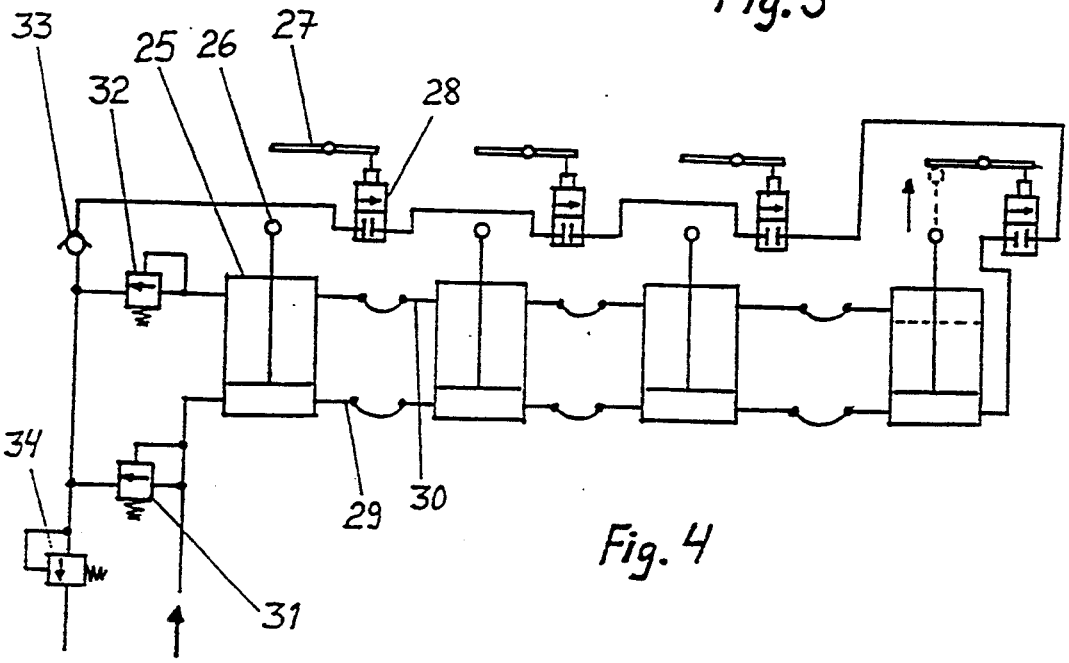
FIG. 4 is a diagram of an alternative hydraulic system.

FIG. 4 shows cylinders 25 connected in parallel. A pressure of ab. 100 bar is conducted along line 29 to the rear of each cylinder. Through sensor valves 28 connected to each cylinder, the same oil is circulated back to the pump. With the pistons in their extreme position, said valves 28 are opened by levers 27, and the oil circulates. Stopping of oil circulation indicates that a bit or the bits are backed. Oil returns over the back valve 33 to the regulation valve 34, which sustains a pressure of ab. 100 bar. Regulation valve 31 directs oil to the return line if a cylinder is backed and has closed respective valve 28. The opening pressure of valve 31 can be for instance 140 bar. Valve 32 is adjustable, and with this valve it is possible to regulate certain counter pressure on the other side of the pistons in situations where pistons are driven outward by pressure.

By means of the systems, overload of even one single bit can be detected as an interruption of back-flow oil. Then the feeding of the tool may be switched-off or the feeding force reduced so much that even a single bit sustains the force without damage if only one of the bits hits on a hard surface such as rock. After this, driving is continued with a small pushing force till the bit has managed the rock and moved off the backed position or till the oncoming rock has broadened out in front of several bits. Then the backed single bit is no longer loaded by a very great pushing force and has the possibility of reaching its extreme position. Hereafter it can be tested whether a greater pushing force could be used. The invention is not limited only to the described embodiments but it can be modified within the limits of the inventive ideas introduced in the patent claims. The flexibility of drill bits can be provided even mechanically in using, for instance, springs or combinations of mechanical and medium operated devices.

I claim:

1. Apparatus for drilling soil or rock comprising a rotatable tool having a drill head, said rotatable tool being moveable in a direction towards said drill head along its axis of rotation to effect drilling;

a plurality of drill bits mounted on said drill head, each of said drill bits being mounted on a respective member secured to said rotatable tool for movement therewith, each of said members being individually moveable between a forward position towards the forward end of said drill head and a rearward position;

means for maintaining said member in said forward position when, in use, the drill bits are under proper load;

means for permitting any one of said members to move rearwardly to said rearward position when, in use, the drill bit is overloaded; and means for determining that, in use, any one of said members has moved rearwardly away from said forward position as a result of overload to enable a driving force applied to said tool to be restricted.

2. Apparatus according to claim 1 wherein said members comprise pistons, said pistons being mounted in cylinders which are fixedly secured to said rotatable tool, and wherein said determining means comprises hydraulic means for determining that, in use, any one of said pistons has moved rearwardly away from said forward position.

3. Apparatus according to claim 2 wherein said piston position maintaining means comprises hydraulic means for applying a hydraulic force to any one of said pistons.

4. Apparatus according to claim 3 further comprising means for adjusting said hydraulic force.

5. A method for regulating the penetration of a drilling apparatus in rock or soil, said method comprising the steps of:

a) providing an apparatus for drilling rock or soil, said apparatus comprising:

a rotatable tool having a drill head, said rotatable tool being moveable in a direction towards said drill head along its axis of rotation to effect drilling;

a plurality of drill bits mounted on said drill head, each of said drill bits being mounted on a respective member secured to said rotatable tool for movement therewith, each of said members being individually moveable between a forward position towards the forward end of said drill head and a rearward position;

means for maintaining said member in said forward position when, in use, the drill bits are under proper load;

means for permitting any one of said members to move rearwardly to said rearward position when, in use, the respective drill bit is overloaded; and means for determining that, in use, any one of said members has moved rearwardly away from said forward position as a result of overload to enable a driving force applied to said tool to be restricted;

b) applying a drilling force to said rotatable tool to effect drilling of rock or soil with the drill bit under proper load; and c) upon determining that one or more of said members has moved rearwardly away from said forward position, restricting said drilling force.

6. A method according to claim 5 further comprising the steps of:

d) after restricting said drilling force, continuing drilling until said one or more members return to their forward position; and e) increasing said drilling force to again place the drill bits under proper load.

7. A method according to claim 5 wherein, in step c), the drilling force is restricted, at most, to an amount such that a single drill bit, in use, is under proper load.

* * * * *